US005836710A

United States Patent [19]

Owen

[11] Patent Number: 5,836,710

[45] **Date of Patent: *Nov. 17, 1998**

[54] LASER/INKJET PRINTABLE SHEET ASSEMBLY AND PRINTING METHOD

[75] Inventor: Sonia Owen, Covina, Calif.

[73] Assignee: Avery Dennison Corporation, Pasadena, Calif.

[ * ] Notice: The term of this patent shall not extend beyond the expiration date of Pat. No. 5,558,454.

[21] Appl. No.: 691,943

[22] Filed: Aug. 5, 1996

Related U.S. Application Data

[62] Division of Ser. No. 348,370, Dec. 1, 1994, Pat. No. 5,558,454.

[51] Int. Cl.[6] ..... B42D 15/00

[52] U.S. Cl. ..... 402/79; 281/38

[58] Field of Search ..... 283/61, 62, 67; 402/79; 281/38

[56] References Cited

U.S. PATENT DOCUMENTS

| | | | |
|---|---|---|---|
| 612,078 | 10/1898 | Wickham . | |
| 764,701 | 7/1904 | Ayres . | |
| 1,769,395 | 7/1930 | Selden . | |
| 2,316,384 | 4/1943 | Abramson . | |
| 4,422,672 | 12/1983 | Levi . | |
| 4,430,015 | 2/1984 | Nerlinger . | |
| 4,431,325 | 2/1984 | Colby . | |
| 4,447,481 | 5/1984 | Holmberg et al. . | |
| 4,479,733 | 10/1984 | Segal . | |
| 4,636,179 | 1/1987 | Gentile et al. . | |
| 4,643,455 | 2/1987 | North et al. . | |
| 4,662,770 | 5/1987 | Block . | |
| 4,779,897 | 10/1988 | Schall et al. . | |
| 4,784,508 | 11/1988 | Shannon . | |
| 4,803,795 | 2/1989 | Questel et al. . | |
| 4,887,925 | 12/1989 | Groswith, III et al. . | |
| 4,910,066 | 3/1990 | Foisle . | |
| 4,911,777 | 3/1990 | Truc et al. . | |
| 4,961,666 | 10/1990 | Pitts et al. . | |
| 4,984,906 | 1/1991 | Little . | |
| 4,990,018 | 2/1991 | Best et al. . | |
| 5,016,370 | 5/1991 | Rhian et al. . | |
| 5,076,490 | 12/1991 | Dulin . | |
| 5,087,238 | 2/1992 | Olson . | |
| 5,135,261 | 8/1992 | Cusack et al. . | |
| 5,138,228 | 8/1992 | Curry . | |
| 5,180,461 | 1/1993 | Widmann . | |
| 5,299,879 | 4/1994 | Burrow . | |
| 5,503,435 | 4/1996 | Kline | 283/67 |
| 5,558,454 | 9/1996 | Owen | 402/79 |
| 5,599,128 | 2/1997 | Steiner . | |

*Primary Examiner*—Willmon Fridie, Jr.
*Attorney, Agent, or Firm*—Oppenheimer Wolff & Donnelly LLP

[57] ABSTRACT

A one-piece divider assembly which is folded over along one edge may be fed into a laser printer, ink jet printer, or photocopier. The assembly includes a divider sheet having a binding edge, a reduced-thickness binding edge region extending inwardly from the binding edge, and a main body with an integral, outwardly-extending tab. The divider sheet has a folding line which is inset from and which runs parallel to the binding edge. The binding edge region has a folding portion defined on one side by the binding edge and on the opposite side by the folding line. The binding edge region also has a non-folding portion adjacent to the folding portion. The folding portion includes spaced holes for a binder. A binding edge reinforcement film may be adhered to at least a portion of the binding edge region. The folding portion of the binding edge region may be folded over at the folding line, and the folding portion may be releasably tacked with a single-use adhesive to the non-folding portion of the divider sheet. In an alternative embodiment, the main body may have an upper sheet and a lower sheet that are adhered to one another.

45 Claims, 2 Drawing Sheets

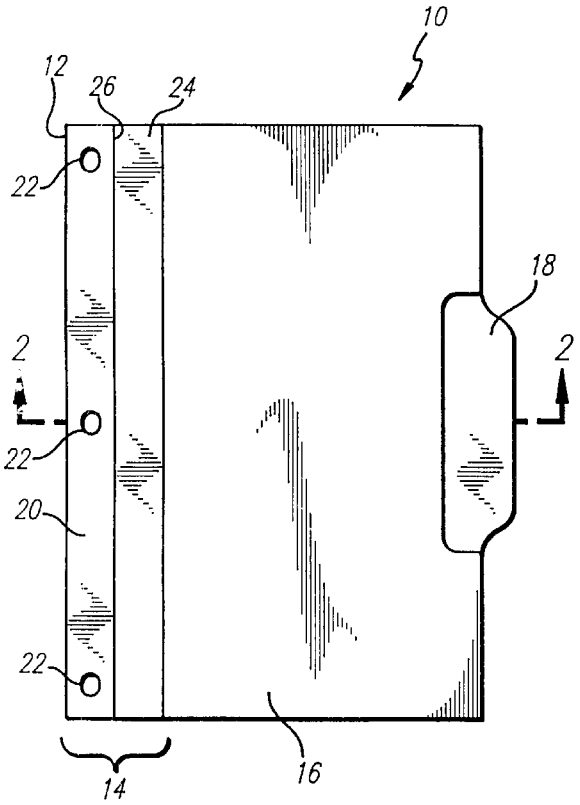
FIG. 1
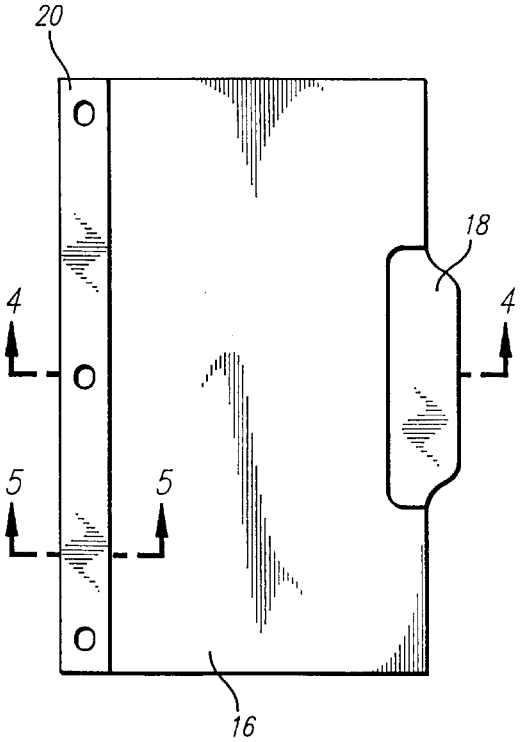
FIG. 3
FIG. 5
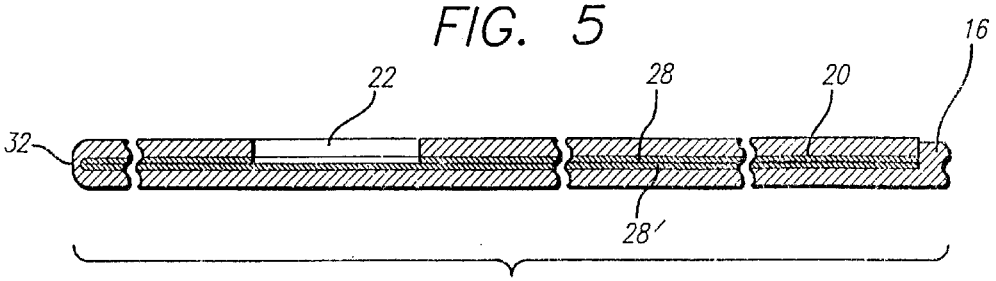

LASER/INKJET PRINTABLE SHEET ASSEMBLY AND PRINTING METHOD

CROSS-REFERENCE TO RELATED APPLICATION

This is a divisional of application Ser. No. 08/348,370, filed on Dec. 1, 1994, which issued on Sep. 24, 1996, as U.S. Pat. No. 5,558,454.

FIELD OF THE INVENTION

This invention relates to the field of tabbed index dividers for three-ring or similar notebooks, and in particular to a tabbed divider upon which the user may print personalized text using a standard laser-jet printer, ink-jet printer, photocopier or other common printing apparatus.

BACKGROUND OF THE INVENTION

The width of a standard index tab divider for a three-ring notebook containing sheets of pre-punched 8½ by 11 inch notebook paper is 9×11 inches (including the width of the tab). Unfortunately, many standard laser-jet or ink-jet printers or photocopiers can only accept rectangular sheets of width not exceeding 8½ inches. Accordingly, there has been a need for an assembly and accompanying method for conveniently printing upon the face and tab portion of a 9 inch×11 inch divider using a laser or ink jet printer or photocopier which has an 8½ inch width restriction.

One approach has been to print on a standard 8½×11 inch sheet, then adhere a pre-punched spine strip along an edge of the sheet. The sheet may then be inserted into a ringed binder. However, this arrangement is somewhat inconvenient to a user for two reasons. First, for assemblies in which the spine strips are entirely separate from the divider sheets, the user must separately store both components. Storage areas can become cluttered and spine strips misplaced. Secondly, the user must very carefully attach the pre-punched spine strip to the divider sheet. If the spine strip is misaligned, the user must reposition the strip or may even need to discard the entire assembly, particularly if a permanent pressure sensitive adhesive is used on the spine. Additionally, this arrangement is somewhat user-unfriendly due to the time it takes to remove a release liner from the spine strip and apply the spine strip to the divider.

Common printers and copiers may have a thickness restriction as well as a width restriction, due to interior clearances and due to the radii of bends in the sheet path through those machines. Uneven thickness can cause skewing in the transport of sheets through the printer and possibly jamming. It is therefore important to minimize nonuniformity of thickness over the entire assembly. Holmberg U.S. Pat. No. 4,447,481 teaches that assemblies for feeding into common printers should have a substantially uniform thickness.

It would be preferable to provide a one-piece laser printable divider having the pre-punched spine portion already attached to or integral with the index divider sheet. Furthermore, there is a need for an easy-to-use printable index divider which requires a minimum number of steps to print and use. Additionally, there is a need for a divider which may have dimensions of 8½×11 inches or less for the printing stage, but which may be made wider after printing so that the tab will extend beyond an 8½ inch wide sheet.

SUMMARY OF THE INVENTION

Generally speaking, a one-piece divider assembly which is folded over along one edge for feeding into a laser printer, ink jet printer or photocopier has a divider sheet having a binding edge. A longitudinal binding edge region extends inwardly from the binding edge. The divider sheet also has a main body with an outwardly-extending tab. The binding edge region has a non-folding portion and, adjacent to it and releasably tacked to it, a folding portion.

In accordance with various other features of different embodiments of the present invention, a one-piece divider assembly may have a binding edge reinforcement film which adheres to at least a portion of the binding edge region. A longitudinal folding line which is inset from and which runs parallel to the binding edge may also be included. The folding portion may be defined on one side by the binding edge and on the opposite side by the folding line. The folding portion may include one or more spaced ring apertures so that the divider may be inserted into a ring binder. The assembly may further include a tab reinforcement film member which adheres to at least one surface of the tab. The tab or a reinforcing film applied to the tab may have a coated surface which accepts laser, ink jet and photocopier printing. The folding portion of the divider assembly may be reduced in thickness relative to the main body of the sheet. Similarly, the tab portion may be reduced in thickness so that after lamination, the reinforced tab is comparable in thickness to the main body.

In accordance with a specific embodiment, a one-piece divider assembly may be folded over along one edge for feeding into a printer. The divider may have a divider sheet which has a binding edge and a debossed binding edge region extending inwardly from the binding edge. The divider sheet may also have a main body which has an integral, outwardly-extending tab. The divider sheet may have a folding line which is inset from and which runs parallel to the binding edge. The binding edge region may have a folding portion which is defined on one side by the binding edge and on the other side by the folding line. The binding edge region may also have a non-folding portion. The folding portion may include spaced ring apertures. A binding edge reinforcement film may be adhered to at least a portion of the binding edge region. The folding portion of the binding edge region may be folded over at the folding line, and the folding portion may be releasably tacked with a single use adhesive to the non-folding portion.

In accordance with various additional features, the one-piece divider assembly may further include a tab reinforcement film member which is adhered to at least one surface of the tab. The tab reinforcement film member may have a printable surface which accepts laser, ink jet and photocopier printing. The folded divider assembly may have a width of approximately 8¼ inches measured from the fold line to the edge of the tab. Such dimensions permit a laser printer which has a minimum margin of ½ inch to print ¼ inch inwardly from the edge of the tab. This provides a kind of "false margin" which appears to overcome the minimum margin requirements of many laser printers. The tab may be ⅜ inch wide with a corresponding main body width of 7⅞ inch, so that a laser printer paper sensor which requires a sheet size of at least 7⅞ inches will be able to sense the assembly. The binding edge reinforcement film may be stable in the presence of temperatures up to approximately 375°–450° Fahrenheit that are generated within a laser printer. The folding line may be a scored line, or may alternatively be spaced indentations or even spaced die-cuts.

Furthermore, the main body may have both an upper sheet and a lower sheet that are adhered to one another. The upper and lower sheets may both be paper sheets, plastic sheets, or one paper and one plastic.

A method of preparing printed index dividers from a laser or ink jet printable index divider may be as follows. The index dividers may have a sheet which has a binding edge, a binding edge region extending inwardly from the binding edge, and a tab edge. The binding edge region may have a folding portion and a non-folding portion. The method may include the following steps. A tab may be formed from the sheet such that the tab extends from the tab edge. At least a portion of the binding edge region may be debossed. The folding portion of the binding edge region may be folded over onto the non-folding portion of the binding edge region. The folding portion of the binding edge region may be adhesively tacked to the non-folding portion of the binding edge region. The index divider may be fed into a laser printer, ink jet printer, or photocopier. Indicia may be printed onto the index tab. The folding portion of the binding edge region may be unfolded from the non-folding portion of the binding edge region.

In accordance with various other steps which may be included in the method, binder holes may be formed in the binding edge region of the assembly. The folding portion of the binding edge region may be adhered to the non-folding portion of the binding edge region with a single use adhesive. The tab may be reinforced with a tab reinforcing film that has a laser or ink jet-printable coating. At least a part of the binding edge region may be reinforced with a reinforcing film. A score line may be provided in the binding edge region to accommodate folding of the folding portion. The score line may run parallel to the binding edge, and the step of folding the folding portion of the binding edge region may include folding the folding portion over at the score line.

Other objects, features and advantages will become apparent from a consideration of the following detailed description and from the accompanying drawings.

BRIEF DESCRIPTION OF THE DRAWINGS

FIG. 1 is a top perspective view of a laser printable index divider having an index tab extending from one edge thereof and a foldable apertured binding edge;

FIG. 3 is a top perspective view of the assembly of FIG. 1 with the folding portion folded over at the score line;

FIG. 5 is detailed sectional view of the folded over binding edge region taken along Section 5—5 of FIG. 3.

DETAILED DESCRIPTION OF A PREFERRED EMBODIMENT

Figure 2:
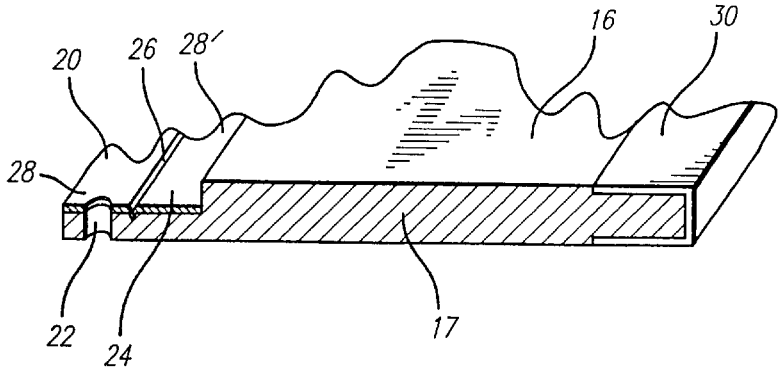
FIG. 2 is a cross sectional view taken across Section 2—2 of FIG. 1 showing the unfolded, debossed binding edge and the reinforced index tab.

FIG. 1 illustrates a one-piece divider assembly which may be folded over at the binding edge. The assembly is suitable for printing in laser printers, ink jet printers, photocopiers and other printers. The assembly 10 has a binding edge 12 and an integral, debossed binding edge region 14 extending inwardly into the sheet from binding edge 12. The assembly also has a main body 16 with an integral, outwardly extending tab 18. A heavy paper or cardstock sheet 17 forms the structural basis for the entire divider assembly 10.

The binding edge region 14 may have a folding portion 20 which has spaced ring apertures 22. The binding edge region 14 may also have a non-folding portion 24. Folding portion 20 and non-folding portion 24 are separated by a folding line 26, about which folding portion 20 may fold. Longitudinal folding line 26 is inset from and runs parallel to binding edge 12. In the embodiment of FIG. 1, the folding line is scored to improve the regularity and proper positioning of the fold. Such scoring may be notches, cuts, or a single indented line as shown in FIG. 2.

FIG. 2 is a sectional view taken across Line 2—2 of FIG. 1. FIG. 2 shows that the folding portion 20 and the non-folding portion 24 of binding edge region 14 are debossed or calendared. That is, binding edge region 14 is reduced in thickness somewhat relative to main body portion 16. Binding edge region 14 is also laminated with a reinforcement film 28 which is adhered to one surface of the binding edge region 14.

FIG. 2 also shows that tab 18 is reinforced with a tab reinforcement film 30 which is adhered to both sides of the tab. In this instance, tab reinforcement film 30 is an adhesively-coated, symmetrical member that is folded about and adhered to the tab at a line of symmetry of the reinforcement film member. The adhesive for the tab reinforcement film should be stable to temperatures of up to 450 degrees so as to remain stable in the high heat environment of a laser printer or photocopier. FIG. 2 further shows that fold line 26 is a line of indentation which extends into the divider sheet.

FIG. 3 illustrates the assembly of FIG. 1 with folding portion 20, which is also known as a folding flap, having been folded over and adhesively tacked to non-folding portion 24. In this configuration, the assembly is ready to be fed into a laser printer, ink jet printer or photocopier. The printer will print onto the tab 18 and/or the main body portion 16. The tab reinforcement film 30 may be provided with a laser printable coating which will receive indicia from a variety of different printers.

Figure 4:
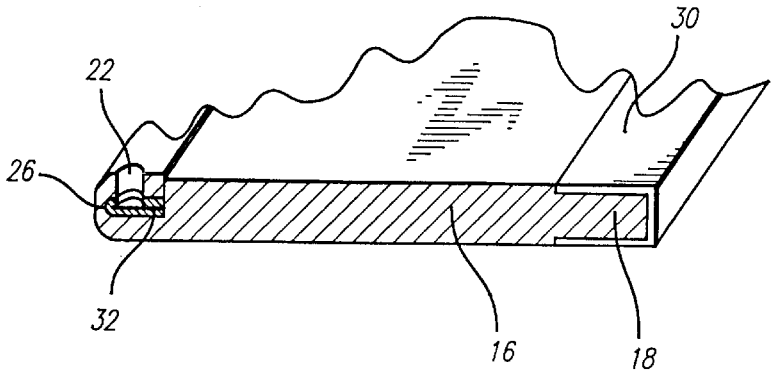
FIG. 4 is a sectional view taken across Section 4—4 of FIG. 3 showing the folding portion having been folded over onto the non-folding portion of the binding edge region.

FIG. 4 is a sectional view taken across Section 4—4 of FIG. 3. FIG. 4 shows that folding portion 20 is folded over at score line 26 and is tacked with a single use adhesive layer 32 to non-folding portion 24. The purpose of this single use adhesive layer 32 is to temporarily maintain folding portion 20 in the folded position of FIG. 4 so that the assembly will pass through the printer without jamming. In this folded configuration, the assembly is substantially flat and has a width of 8¼ inches as measured from the edge of the folded portion to the very edge of the index tab. FIG. 4 also shows that the main body sheet may have a slightly reduced thickness at tab 18 to help compensate for the added thickness of tab reinforcement film 30. The thickness reduction may be accomplished with a standard calendaring process.

FIG. 5 is a sectional view of the binding edge region taken along Line 5—5 of FIG. 3. FIG. 5 shows that the debossing has reduced the thickness of the binding edge region such that when folding portion 20 is folded over, the total thickness of the folded over portion is approximately the same as the thickness of the main body of the sheet. Various embodiments of the present invention may have a greater or lesser degree of debossing. The general idea is to prevent the folded over binding edge region from bulging upward to any substantial extent, thereby causing jamming in the printer. However, the thickness of the folded-over portion may be slightly greater than the thickness of the main body.

With respect to materials, the following illustrative materials and dimensions are provided for purposes of illustration but not of limitation. The assembly may be made from a single sheet of paper stock which is approximately 6.5 to 8.0 mils thick and is approximately 9 inches wide. One suitable type of paper stock is from the Champion Paper Company in a basis weight of 57 pounds per 1800 square feet. Various laser printable cardstocks and papers of various thickness are also acceptable.

A suitable adhesive for tacking down folding portion 20 to non-folding portion 24 is the 45858 Aqueous Fugitive Adhesive from Swift Adhesives Division of Reichhold Chemicals, Inc. of Research Triangle Park, N.C. When wet, this adhesive creates a good paper-to-paper bond. However, when it dries, the bond will still hold until it is physically broken. Once the adhesive bond is broken, as for instance after a user has unfolded the folding portion 20 from the non-folding portion 24 and broken the adhesive seal, the dry adhesive is no longer tacky and will not stick to anything. When dry and tackless, the adhesive is virtually unnoticeable.

The edge reinforcing film, which serves to reinforce the hole punches 22, may be a 0.5–2.0 mil thick strip of clear polyester film, coated on one side with a thermally-activated adhesive which remains stable at the temperatures of between 375–450 degrees Fahrenheit that may be generated within a laser printer. Such a film and suitable adhesive are available from Protect-All, Inc. of Darien, Wis. The tab reinforcing film, based on 0.5–2.0 mil polyester film, is coated on one side with a stable heat-activated adhesive for attachment to the tab portion of the divider sheet and on the other side with a coating that enhances laser, ink jet or copier printability. One such coating is available from Precision Coatings, Inc. of Walled Lake, Mich.

A number of companies have performed the process of bonding these reinforcing films to index dividers, and the process is well known. One such company is Avery Dennison Specialty Products Division of Rolling Meadows, Ill. In the embodiment illustrated in the drawings, the edge reinforcing adhesive coating is approximately 0.5 mil thick and the tab adhesive coating is approximately 1 mil thick, although thicker or thinner coats may be used.

It should be noted that both the edge and tab reinforcing films should also be stable in the high temperature environment of present-day laser printers. Consequently, the reinforcement films, coatings and adhesives should be temperature stable up to a temperature of approximately 450° Fahrenheit. However, if printers are developed that do not generate such temperatures, this requirement may be relaxed.

With respect to dimensions, in its unfolded position, the assembly may be 11 inches long by 9 inches wide as measured from the binding edge 12 to the outermost edge of the tab 18. Tab 18 may extend ½ inch outwardly of the main body 16 and may have various lengths for various purposes, with common lengths being 3¼ inches for a three-tab set, 1⅞ inches for a five-tab set and 1¼ inches for an eight-tab set.

Folding portion 20 may be ¾ inch wide so that, in the folded configuration, the assembly is 11 inches long by 8¼ inches wide as measured from the folded edge to the outermost edge of the tab. An advantage of having a folded divider width of 8¼ inches relates to a limitation of some printers which are unable to print within ½ inch of the edges of an 8½ inch wide sheet. This would prevent printing on a tab that extends only ½ inch. A ¼ inch offset, possible with the narrower sheet, effectively reduces this unprintable zone by ¼ inch, allowing printing on half of the tab. By increasing the width of the folded portion to 1 inch, the folded divider width decreases to 8 inches, allowing printing over the full extent of the tab. Thus, increasing the width of the folded portion increases the printable area on the tab.

One more consideration in choosing the width of the folding portion is the need to avoid intersecting the holes 22, which extend to a distance of about ½ inch from the binding edge. That is, the fold line should be inset toward the main body from the inner edge of the holes 22. With all of the aforementioned considerations in mind, a practical range for the inset of the score line 26 is between about ⅝ inch and 1 inch from the binding edge 12.

The hole-reinforcing film 28 (FIG. 2) may cover an area which includes the score line and which strengthens the assembly against tearing along the score line and also enhances the appearance of the product following unfolding.

The binding edge 14 is reduced in thickness compared to the main body of the divider sheet. This may be achieved by compression of the sheet, referred to as debossing or calendaring. Processes for debossing papers and cardstocks, which typically utilize calendaring devices having a calendaring cylinder and an anvil roll between which the sheet is fed, are well known in the art. Ideally, the thickness reduction would be more than 50% of the original sheet thickness so that the reinforced and folded-over thickness would equal that of the original sheet.

The difficulty of increasing the density of paper beyond the density of the constituent fibers, however, limits the thickness reduction for a 6.5–8 mil sheet to less than about 1.5–3.5 mils. This yields, after reinforcing and folding, a thickness on the folded edge in the neighborhood of 10–11 mils, which is near the maximum thickness that most printers will tolerate. While not perfectly coplanar, such sheets will reliably run through common laser and ink jet printers. If a higher degree of coplanarity is desired, an alternative method of creating a thickness step at the binding edge may be employed in which the body of the divider sheet is constructed as a laminate totalling less than 10 mils in thickness over the main body of the sheet, and a partial laminate totalling less than about 5 mils in the binding edge region.

In the embodiments shown, both the edge reinforcing film and the calendaring or debossing are done on the top side of the divider. However, the debossing could be done on the back side of the divider, and the edge reinforcing film could be provided on the back side as well. By putting the reinforcing film on the backside of the assembly, there is paper-to-paper lamination when flap 20 is folded over onto non-folding portion 24. This may be desirable in some embodiments.

Figure 6:
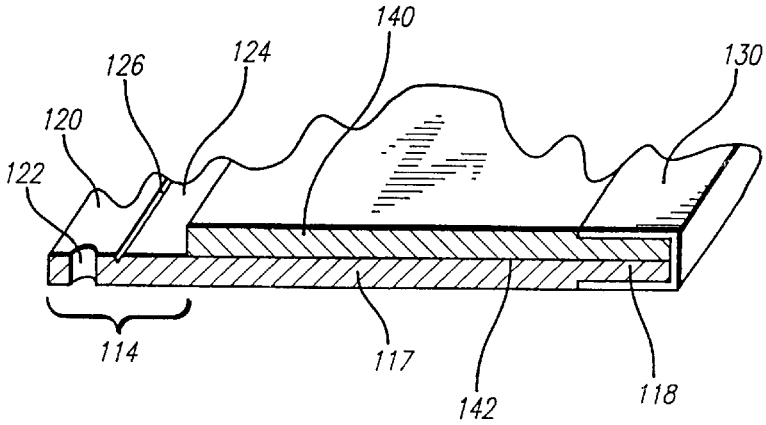
FIG. 6 is a cross-sectional view similar to FIG. 2 showing an alternative, two-sheet embodiment of the invention.

FIG. 6 illustrates an alternative, laminated two-ply embodiment having a lower sheet 117 and an upper sheet 140 that is permanently adhered to the lower sheet. As with the previous embodiments, the embodiment of FIG. 6 includes a binding edge region 114. However, binding edge region 114 is an extension of lower sheet 117 and is not normally debossed. Upper sheet 140 is somewhat narrower than lower sheet 117, so that upper sheet 140 does not cover binding edge region 114. Tab 118 extends outwardly from the main body of the divider, and is reinforced with polyester tab reinforcement film 130.

Upper sheet 140 and lower sheet 117 are typically bonded together with an adhesive that is stable against flow and degradation at the high temperatures encountered in laser printers and copiers. One suitable adhesive for laminating the two sheets together is Nicomelt L-2274, manufactured by Malcolm Nicol & Co. Other hot melt adhesives may also be used, such as that sold under the trade identification Bostik 4101.

Binding edge region 114 includes a folding portion 120, a scored folding line 126 and a non-folding portion 124. Like the embodiment of FIGS. 1–5, the manufacturer provides the embodiment of FIG. 6 to the end user with folding portion 120 folded over and adhered with a single-use adhesive to the non-folding portion 124.

Upper sheet 140 and lower sheet 117 are typically each approximately 3 to 4 mils thick and are made of sheet paper. Alternatively, upper sheet 140 and/or lower sheet 117 may be made of polyester or other plastic. With at least one of the sheets being a strong plastic sheet, there is less of a need to provide the binding edge reinforcement film 28 that is required for all-paper embodiments. Preferably, sheets 117 and 140 are both made of the same material so that the divider will not be prone to curling when subjected to changing humidity conditions.

With the lower and upper sheets having approximately the same thickness, the divider has a substantially uniform thickness across the folded-over binding edge region and the main body of the divider. That is, there is no sudden increase in thickness at the juncture of the folded-over portion and the main body, as there typically is in the one-sheet embodiment shown in FIG. 4.

In conclusion, it is to be understood that the foregoing detailed description, and the accompanying drawings relate to the presently preferred illustrative embodiments of the invention. However, various changes may be made without departing from the spirit and the scope of the invention. Thus, by way of example and not of limitation, any of a variety of materials may be used. For example, thinner or thicker paper material may be used for the main sheet portion of the laser printable index divider. Tab 18 is generally integral to the main sheet 16. However, index tab 18 may be a separate component that is simply adhered to an edge of the assembly. Index tab 18 is shown in the figures as being on the right hand side of the assembly. However, the tab 18 may be on other sides of the assembly. For instance, embodiments of the present invention can be provided having tabs on the top or bottom.

The binding edge reinforcement 28 may extend the entire width and length of the assembly. Alternatively, a second binding edge reinforcement layer may be provided on the backside of the sheet.

Tab sheet assemblies of various dimensions may also be provided. For example, some binders are only 5 inches wide by 10 inches long. Dividers may be sized appropriately for use in such a binder, or may be sized to meet the size requirements of any of a variety of other binders. Additionally, the base sheet may be made of temperature stable plastic sheet or polymer material.

As another alternative, the tab portion may be formed by providing a pattern of microperforations which define the tab edge and the tab portion. The assembly could be printed with the microperforations still intact, so that a fully rectangular sheet is fed into the printer. The user would then tear the assembly along the micro-perforations to define a tab edge having an outwardly extending tab. The user would then discard the resulting excess strip of sheet material. It may be noted that "microperforations" typically refer to perforations which have approximately 35 cuts and ties per linear inch. "Microperforations" more generally refers to perforations which leave a substantially smooth edge when torn.

Accordingly, it is to be understood that the detailed description and the accompanying drawings, as set forth hereinabove, are not intended to limit the breadth of the present invention, which should be inferred only from the following claims and their appropriately construed legal equivalence, rather than from the examples given.

What is claimed is:

1. An assembly which is folded over along one edge for feeding into a laser printer, inkjet printer, or photocopier, the assembly comprising:

a sheet having a binding edge and a binding edge region extending inwardly from said binding edge;

said sheet having a longitudinal folding line which is inset from and which runs substantially parallel to said binding edge;

said binding edge region having a folding portion defined on one side by said binding edge and on an opposite side by said folding line, and a non-folding portion; and a binding edge reinforcement film which is adhered to at least a portion of said binding edge region;

wherein said folding portion of said binding edge region is folded over at said folding line to said non-folding portion of said sheet.

2. The assembly of claim 1 wherein said sheet includes a main body having an integral, outwardly-extending tab, and said assembly thereby defines a one-piece divider assembly.

3. An assembly which is folded over along one edge for feeding into a laser printer, inkjet printer, or photocopier, the assembly comprising:

a sheet having a binding edge and a binding edge region extending inwardly from said binding edge;

said binding edge region having a folding portion and a non-folding portion adjacent to said folding portion;

wherein said folding portion is folded over to said non-folding portion.

4. The assembly of claim 3 wherein said sheet includes a main body having an integral, outwardly-extending tab, and said assembly thereby defines a one-piece divider assembly.

5. A method of preparing printed sheets from a sheet having a binding edge and a binding edge region extending inwardly from the binding edge, the binding edge region having a folding portion and a non-folding portion, said method comprising the steps of:

folding the folding portion of the binding edge region over generally onto the non-folding portion of the binding edge region;

feeding the sheet into a laser printer, inkjet printer or photocopier;

printing indicia onto the sheet; and unfolding the folding portion of the binding edge region from the non-folding portion of the binding edge region.

6. The method of claim 5 wherein the sheet has an index tab extending out from a tab edge thereof.

7. The method of claim 6 wherein said printing includes printing the indicia onto the index tab.

8. The method of claim 5 wherein said feeding is after said folding, and said unfolding is after said printing.

9. A printable sheet assembly, comprising:

a sheet; and a single use adhesive on said sheet;

said sheet being folded onto itself and held in a folded condition with said single use adhesive;

said sheet being adapted when in the folded condition to be fed into a laser printer, inkjet printer or photocopier for a printing operation thereon; and said sheet being adapted after the printing operation to be unfolded with said single use adhesive thereby released.

10. The assembly of claim 9 wherein said sheet has a tab extending outwardly from one edge thereof.

11. The assembly of claim 10 wherein said sheet has a binding edge opposite to said one edge.

12. The assembly of claim 11 further comprising reinforcing film on said sheet along said binding edge.

13. The assembly of claim 11 wherein said sheet includes ring binder through-holes proximate to said binding edge.

14. The assembly of claim 9 wherein said sheet includes a folding line along which said sheet is folded into the folded condition.

15. A printable sheet assembly, comprising:

a sheet having a tabbed edge and an opposite edge; and a longitudinal fold indicator on said sheet between said opposite edge and said tabbed edge;

said sheet is foldable on said fold indicator for feeding into a laser printer, inkjet printer or photocopier for a printing operation thereon and after the printing operation is unfoldable.

16. The assembly of claim 15 wherein said opposite edge comprises a binding edge.

17. The assembly of claim 16 wherein said fold indicator comprises a fold line on said sheet.

18. The assembly of claim 16 further comprising binding edge reinforcement film on said sheet along said binding edge.

19. The assembly of claim 18 wherein said sheet includes ring binder through-holes which pass through said reinforcement film.

20. The assembly of claim 16 wherein said sheet includes a main body portion, and said tabbed edge includes an outwardly-extending tab integral with said main body portion.

21. The assembly of claim 16 wherein said sheet includes ring binder through-holes proximate to said binding edge.

22. The assembly of claim 16 further comprising single use adhesive on said sheet for holding said sheet in a folded condition and releasable after the printing operation.

23. The assembly of claim 16 wherein said tabbed edge includes an outwardly-extending tab.

24. The assembly of claim 23 further comprising tab reinforcement film on a surface of said tab.

25. The assembly of claim 24 wherein said reinforcement film has a surface coating which accepts laser, inkjet or photocopier printing.

26. The assembly of claim 25 wherein said tab has a reduced thickness relative to an adjacent main body of said sheet such that with said reinforcement film applied, said tab plus said reinforcement film is comparable in thickness to said main body.

27. The assembly of claim 15 wherein said opposite edge defines a binding edge, said sheet includes a binding edge region adjacent to said binding edge, said binding edge region includes a folding portion adjacent to said binding edge and a non-folding portion adjacent to said folding portion, and said sheet when in a folded condition includes said folding portion folded onto said unfolded portion.

28. The assembly of claim 27 wherein said fold indicator includes a score line on said sheet separating said folding portion from said non-folding portion.

29. The assembly of claim 27 wherein at least one of said folding and non-folding portions is thinner than a main body of said sheet.

30. A method of preparing a printed tabbed sheet, comprising the steps of:

providing a sheet having a tabbed edge and an opposite edge;

folding the sheet;

feeding the folded sheet into a printer or copier and thereby printing indicia on the folded sheet; and after said printing, unfolding the folded sheet.

31. The method of claim 30 wherein the opposite edge is a binding edge of the sheet.

32. The method of claim 31 wherein the sheet has reinforcing film along the binding edge.

33. The method of claim 30 wherein said printing is on an outwardly extending tab of the tabbed edge.

34. The method of claim 30 wherein said folding includes folding the sheet longitudinally.

35. A method of forming a printed sheet, comprising the steps of:

providing a sheet which is folded onto itself and held in a folded condition with a single use adhesive;

passing the sheet in the folded condition into a printer or copier and thereby printing indicia on the folded sheet; and after said printing, releasing the adhesive and unfolding the sheet.

36. The method of claim 35 wherein the sheet has a main body portion, a tab edge having an outwardly extending tab, and a binding edge opposite to the tab edge, and the sheet when in the folded condition has the binding edge folded over onto the sheet and spaced a distance inward from the tab edge.

37. The method of claim 36 wherein said printing includes printing on the tab.

38. A printable sheet assembly, comprising:

a sheet having a tabbed edge; and a binding edge region attached to said sheet opposite to said tabbed edge, said binding edge region including a strip having spaced ring apertures and folded onto said sheet in a folded condition;

said sheet with said strip in the folded condition is adapted to be fed into a laser printer, inkjet printer or photocopier for a printing operation thereon; and said sheet and said strip are adapted after the printing operation to be unfolded for insertion into a ringed binder or notebook.

39. The assembly of claim 38 wherein said sheet includes a main body portion, and said tabbed edge includes an outwardly-extending tab integral with said main body portion.

40. The assembly of claim 38 further comprising single use adhesive which releasably holds said strip in the folded condition.

41. The assembly of claim 38 wherein said strip when in the folded condition is folded onto said sheet.

42. A method of preparing a printed tabbed sheet, comprising the steps of:

providing a sheet having a tabbed edge and a binding edge region attached to the sheet opposite to the tabbed edge, the binding edge region including a strip having spaced ring apertures, the strip being folded onto the sheet in a folded condition;

with the strip in the folded condition, feeding the sheet into a laser printer, inkjet printer or photocopier and thereby printing indicia on the sheet; and after said printing, unfolding the strip.

43. The method of claim 42 further comprising after said unfolding, inserting the sheet using the spaced ring apertures into a ringed binder or notebook.

44. The method of claim 42 wherein said printing includes printing on an outwardly extending tab of the tabbed edge.

45. The method of claim 42 wherein said unfolding includes releasing an adhesive which holds the strip in the folded condition.

* * * * *